US006328246B1

(12) United States Patent
Hjort et al.

(10) Patent No.: US 6,328,246 B1
(45) Date of Patent: Dec. 11, 2001

(54) HOLD FOR ROLLS OF A WEB-SHAPED MATERIAL

(75) Inventors: Erik Hjort, Säter; Mats Lind, Hedemora, both of (SE)

(73) Assignee: SCA Hygiene Products AB, Goteborg (SE)

( * ) Notice: Subject to any disclaimer, the term of this patent is extended or adjusted under 35 U.S.C. 154(b) by 0 days.

(21) Appl. No.: 09/605,868

(22) Filed: Jun. 29, 2000

(30) Foreign Application Priority Data

Jul. 1, 1999 (SE) ..... 9902536

(51) Int. Cl.[7] ..... B65H 59/02

(52) U.S. Cl. ..... 242/422.5; 242/597.3; 242/597.4; 242/597.6; 242/599.4

(58) Field of Search ..... 242/597, 597.1, 242/597.2, 597.3, 597.4, 422.4, 422.5, 422.6, 597.5, 597.6, 599, 599.4; D6/521

(56) References Cited

U.S. PATENT DOCUMENTS

| | | | |
|---|---|---|---|
| 1,851,772 | | 3/1932 | Kleinow . |
| 2,171,648 | * | 9/1939 | Ennis et al. . |
| 2,419,798 | | 4/1947 | Stone . |
| 2,632,605 | * | 3/1953 | Lee . |
| 3,346,208 | * | 10/1967 | Hoffman et al. . |
| 3,482,794 | * | 12/1969 | Beardsley . |
| 3,484,052 | * | 12/1969 | Clarke . |
| 3,703,996 | * | 11/1972 | Ulseth . |
| 4,239,163 | | 12/1980 | Christian . |
| 4,660,781 | | 4/1987 | Hazard . |
| 4,690,343 | | 9/1987 | Goetz . |
| 5,402,978 | | 4/1995 | Larson . |
| 5,445,344 | | 8/1995 | Seger et al. . |
| 5,645,247 | * | 7/1997 | Voigt . |
| 5,755,391 | * | 5/1998 | Sacconi . |

FOREIGN PATENT DOCUMENTS 2326402 12/1998 (GB) .

* cited by examiner

*Primary Examiner*—William A. Rivera
(74) *Attorney, Agent, or Firm*—Burns, Doane, Swecker & Mathis, LLP

(57) ABSTRACT

Holder for rolls of web-shaped materials, for example paper, nonwoven or foil, the holder including a shaft (7) intended to be inserted into the centre hole (5) of the roll (2), so that the roll can rotate around the shaft for unrolling the web-shaped material. In order to provide a braking of the rotation of the roll the shaft (7) is provided with at least one resilient member in the form of a leaf spring (10) having one end attached to the shaft and having a free portion (12) which in unloaded position projects radially from the shaft for increasing the radial dimension thereof, the resilient member can be brought to spring towards the spindle. The end (11) of the leaf spring (10) that is connected to the shaft (7) is intended to be inserted and received in a passage (14) in the shaft inside the enveloping surface of the shaft and is provided with a locking element (13) intended to cooperate with a corresponding locking element **(14*a*) on the shaft (7), so that the leaf spring (10) is locked in axial direction on the shaft (7)**.

4 Claims, 4 Drawing Sheets

HOLD FOR ROLLS OF A WEB-SHAPED MATERIAL

TECHNICAL FIELD

The present invention refers to a holder for rolls of web-shaped material, for example paper, nonwoven or foil, said holder comprising a shaft intended to be inserted into the centre hole of the roll, so that the rolls can rotate around the shaft for unrolling the web-shaped material, at which the shaft is provided with at least one resilient member in the form of a leaf spring having one end attached to the shaft and having a free portion which in unloaded position projects radially from the shaft for increasing the radial dimension thereof, said resilient member can be brought to spring towards the shaft.

BACKGROUND OF THE INVENTION

Holders of this kind are commonly used for example for toilet rolls, kitchen rolls, rolls for wiping material for industrial and workshop use etc. The roll is applied on the shaft of the holder and in order that it can simply rotate on the shaft the latter should have a cross-sectional dimension which is clearly smaller than the dimension of the centre hole of the roll. When the user wants to have a piece of paper, he grips the free end of the paper web and pulls so that the roll starts rotating and paper is unrolled. When a desired amount of paper has been unrolled the user cuts the paper web, e g against a tearing edge. Especially for big heavy rolls intended for away from home users, such as companies, public buildings etc. it can be difficult to stop the rotation of the roll in time and too much paper is unrolled before the rotation of the roll stops. This especially applies for rolls having a cardboard core on which the paper is rolled, said rolls often have a smooth inner surface. Besides there will easily be vibrations and noise when big heavy rolls rotate on the spindle.

GB-A-2 326 402 shows a holder for a coreless roll in which the roll is applied on a spindle around which it can rotate. The spindle is provided with a radially projecting resilient member intended to retard the rotation of the roll. The resilient member is applied to the spindle by being clamped around this. This attachment of the resilient member often involves that is can easily slide along the spindle, which can cause problem especially when changing rolls.

U.S. Pat. No. 1,851,722 shows a shaft intended to receive a paper roll, said spindle is provided with slits so that it forms a plurality of resilient fingers, which are designed to retard the rotation of the roll.

OBJECT AND MOST IMPORTANT FEATURES OF THE INVENTION

The object of the present invention is to provide a roll of the above mentioned kind in which the rotation of the roll on the shaft is retarded. The retardation should take place with a continuous and even braking effect and the initial braking effect should not be too high. The braking device should be attached to the shaft in such a way that the change of roll is not made difficult. This has according to the invention been achieved by the fact that the end of the leaf spring that is connected to the shaft is intended to be inserted and received in a passage in the shaft inside the enveloping surface of the shaft and is provided with a locking means intended to cooperate with a corresponding locking means on the shaft, so that the leaf spring is locked in axial direction on the shaft.

According to a preferred embodiment the shaft is provided with a recess into which the free portion of the leaf spring can be pressed and at least partly be received inside the enveloping surface of the shaft.

The free portion of the leaf spring is preferably substantially spoon-shaped, at which the convex surface of the spoon forms a contact surface against the inner surface of the centre hole of the roll.

Further features of the invention are disclosed in the following description.

DESCRIPTION OF DRAWINGS

The invention will in the following be closer described with reference to some embodiments shown in the accompanying drawings.

DESCRIPTION OF AN EMBODIMENT

Figure 1:
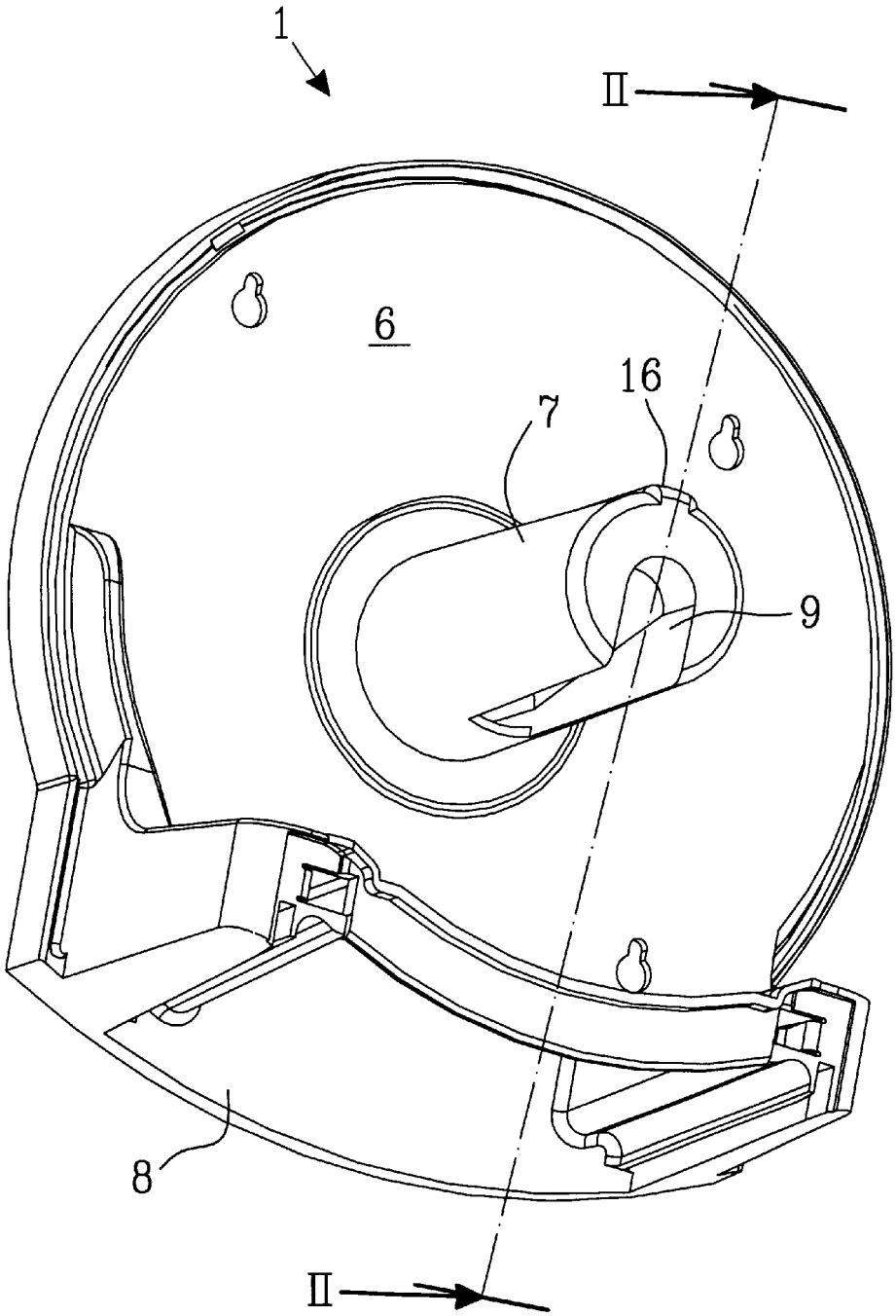
FIG. 1 shows in perspective a part of a holder for example for a paper roll.

The invention refers to a holder 1 for rolls 2 of web-shaped material 3, which refers to all types of flexible web-shaped material, for example plastic or aluminium foil, nonwoven or paper. In the following it will mainly be referred to paper although the invention is not limited to holders for paper rolls. The paper can be in the form of a continuous web 3, at which the holder can be provided with tearing teeth or another sharp tearing edge for cutting a certain length of the paper. The paper web 3 can also be provided with perforations at a certain interval, in order to separate certain lengths of the paper from the roll.

At first hand such rolls 2 are concerned where the paper is rolled on a rigid core 4, but it is also possible that the innermost rolls of the paper web form a stiffening core of the roll, for example by being joined together by water spraying, gluing or the like. The centre hole of the roll is denoted 5.

Figure 2:
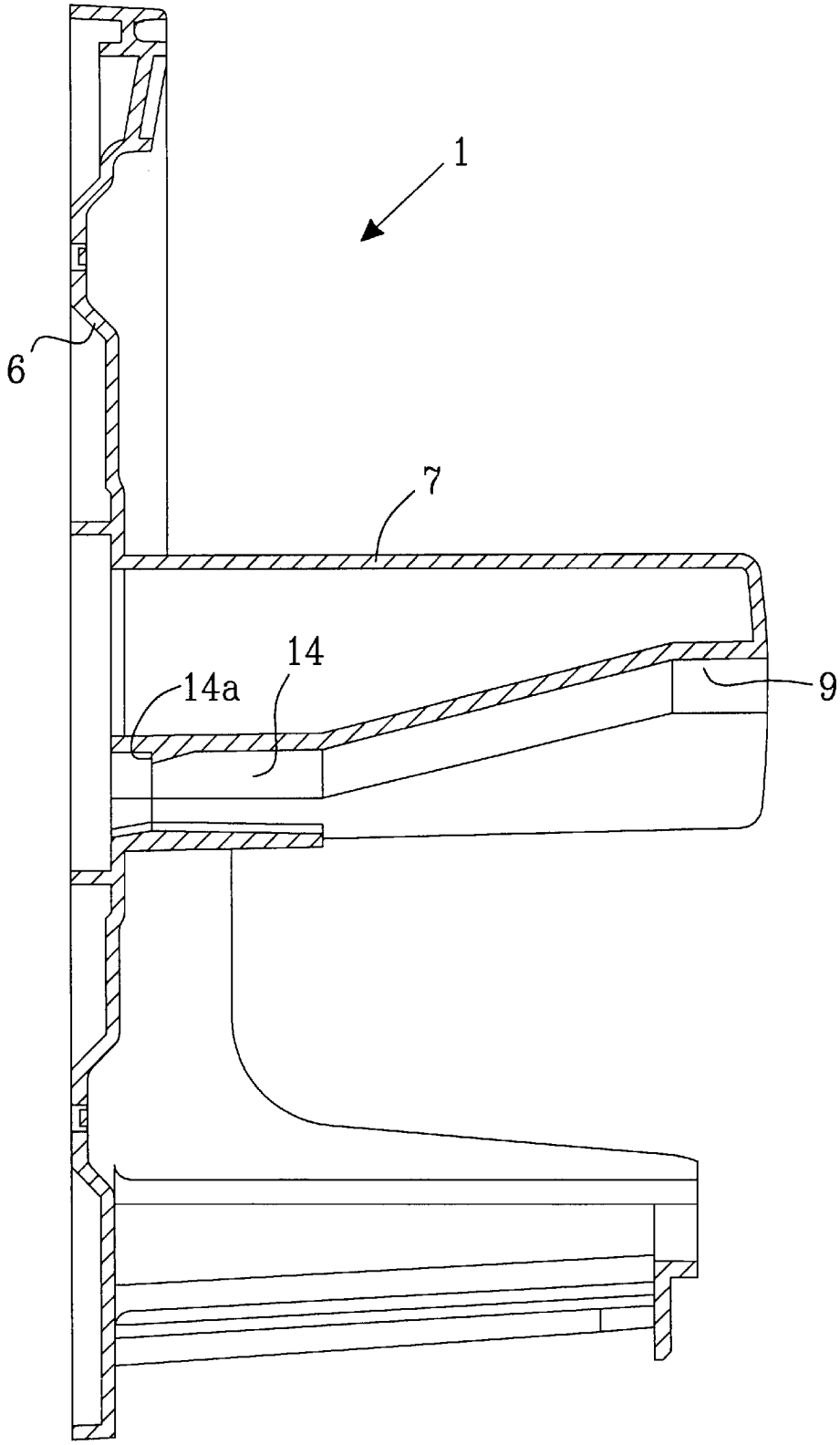
FIG. 2 show a section through the holder according to the line II—II in FIG. 1.
Figure 3:
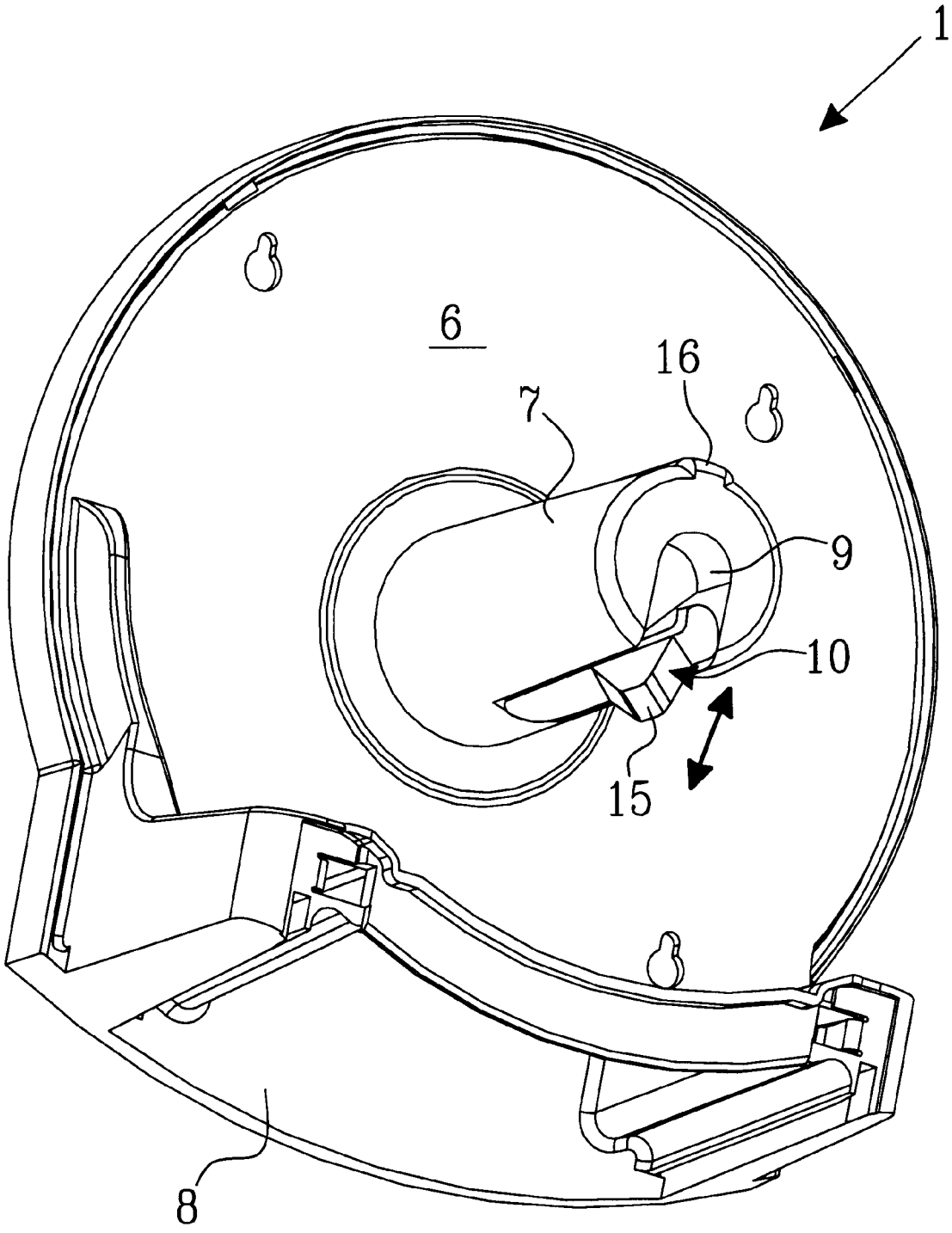
FIG. 3 shows in perspective the holder according to FIG. 1 and having the resilient member connected thereto.

The holder 1 shown in FIGS. 1–3 comprises a plate 6 intended to be attached to a wall, a horizontal shaft 7 on which the roll 2 is applied and a dispensing opening 8 for the paper, said dispensing opening can be provided with tearing means (not shown). The tearing means can of course be designed in many different ways or be lacking completely in case the paper web is provided with perforations.

Figure 4:
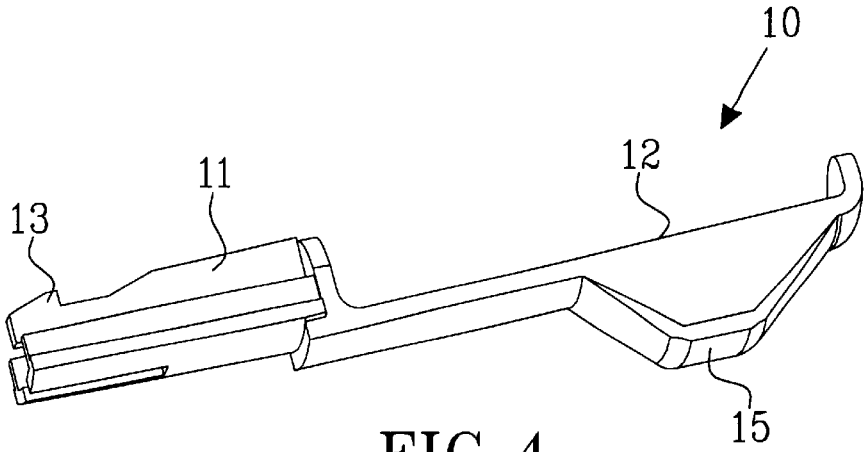
FIG. 4 shows in perspective the resilient member.
Figure 5:
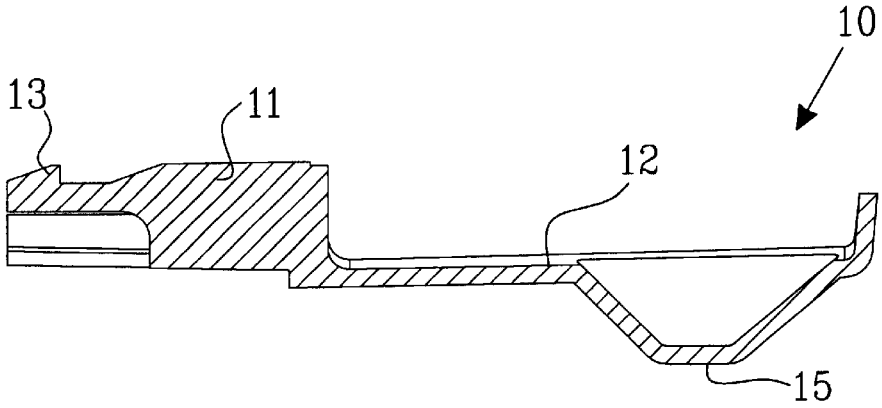
FIG. 5 is a longitudinal section through the resilient member.
Figure 6:
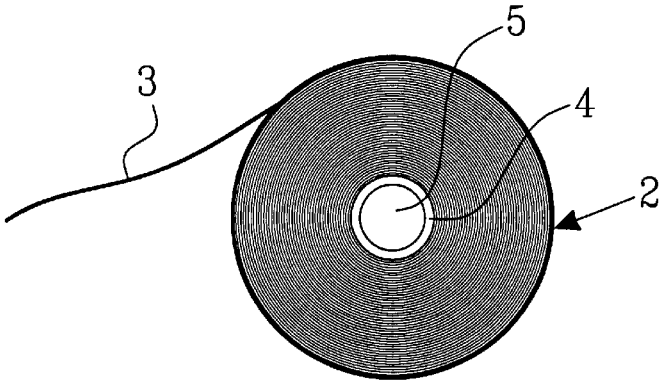
FIG. 6 shows schematically a paper roll.

The shaft is provided with a recess 9 for receiving a resilient member 10, in this case a leaf spring, which may be of plastic, metal or other suitable material. The leaf spring 10, which is shown in detail in FIGS. 4 and 5, is provided with an end 11 intended to be attached to the shaft and is provided with a free portion 12, which is resilient and intended to contact the inner surface of the core 4. The end 11 is intended to be passed into and received in a passage 14 in the shaft inside the enveloping surface thereof and is provided with locking means in the form of a hook 13 intended to be snapped behind an edge 14*a* in the wall of the passage 14, so that the leaf spring 10 is locked in axial direction to the shaft 7.

The resilient portion 12 is substantially spoon-shaped at which, when the spring is mounted in place on the spindle, the spoon part 15 will project radially from the shaft 7. Its convex outside will then form the contact surface against the inside of the core 4 of the paper roll, which will slide against this contact surface as the roll rotates when the paper is unrolled. Through the friction that occurs in connection herewith the rotational movement is braked. The braking occurs softly and with a continuous pressure due to the resilient effect. The initial resistance that has to be overcome for starting the rotation of the roll is relatively low, which is important in order to avoid that the paper web breaks when the unrolling is initiated. Other important advantage of the resilient braking of the rotation of the roll is that vibrations and noise are reduced.

Moreover the spring 10 can take up discrepancies from circular shape of the centre hole of the roll, for example a certain ovality or buckling of the core. Variations in size of the centre hole can also be taken up.

In the embodiment shown the shaft 7 is slightly conical so that the roll can be more easily passed thereon. In order to prevent that the roll due to this conical shape slides outwards on the shaft during the rotation, the conical shape is compensated by a ridge 16 on the side of the shaft 7 which is opposite to the spring 10. The ridge 16 has a height that increases gradually towards the narrow end of the shaft 7, so that the upper edge of the ridge 16 becomes substantially horizontal in use position.

The recess 9 in the shaft has a depth that is adapted to the spring 10 so that this can be pressed into and completely received in the recess 9.

The invention is of course not limited to the embodiment shown. Thus the shape of the spring member 10 can be varied, and it would also be possible to increase the braking effect by arranging two or more springs on the same shaft 7. The invention can also be applied on all types of holders where the roll is applied on and intended to rotate around a shaft.

What I claim is:

1. A holder for rolls of web-shaped materials, said holder comprising a shaft intended to be inserted into a centre hole of a roll, so that the roll can rotate around the shaft for unrolling a web-shaped material, the shaft is provided with at least one resilient member in the form of a leaf spring having one end attached to the shaft and having a free portion which in an unloaded position projects radially from the shaft for increasing a radial dimension thereof, said resilient member is able to be brought to spring towards the spindle, wherein the one end of the leaf spring that is connected to the shaft is received in a passage in the shaft inside an enveloping surface of the shaft and is provided with a locking element for engaging with a corresponding locking device on the shaft, so that the leaf spring is locked in axial direction on the shaft;

the shaft is provided with a recess into which the free portion of the leaf spring is at least partly received inside the enveloping surface of the shaft; and the free portion of the leaf spring is substantially spoon-shaped and a convex outside surface of the spoon forms a contact surface against an interior surface of the centre hole of the roll.

2. The holder of claim 1, wherein the web-shaped material is paper.

3. The holder of claim 1, wherein the web-shaped material is nonwoven.

4. The holder of claim 1, wherein the web-shaped material is a foil.

* * * * *